US008637808B2

(12) United States Patent
Kyogaku et al.

(10) Patent No.: US 8,637,808 B2
(45) Date of Patent: Jan. 28, 2014

(54) MASS DISTRIBUTION MEASURING METHOD AND MASS DISTRIBUTION MEASURING APPARATUS

(71) Applicant: Canon Kabushiki Kaisha, Tokyo (JP)

(72) Inventors: Masafumi Kyogaku, Yokohama (JP); Koichi Tanji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/632,615

(22) Filed: Oct. 1, 2012

(65) Prior Publication Data

US 2013/0092831 A1 Apr. 18, 2013

(30) Foreign Application Priority Data

Oct. 12, 2011 (JP) ..... 2011-225019

(51) Int. Cl.
*H01J 49/00* (2006.01)

(52) U.S. Cl.
CPC ..... *H01J 49/00* (2013.01)
USPC ..... 250/281; 250/282

(58) Field of Classification Search
USPC ..... 250/281, 282
See application file for complete search history.

(56) References Cited

U.S. PATENT DOCUMENTS 5,567,872 A 10/1996 Kyogaku et al.
7,064,318 B2 * 6/2006 Bui ..... 250/282
2012/0298859 A1 11/2012 Tanji et al.

FOREIGN PATENT DOCUMENTS

JP 2007-086610 A 4/2007
JP 2007-157353 A 6/2007

* cited by examiner

*Primary Examiner* — Kiet T Nguyen
(74) *Attorney, Agent, or Firm* — Fitzpatrick, Cella, Harper & Scinto

(57) ABSTRACT

To provide a method that reduces an influence of dependence of an ionizing beam in an incident direction or uneven irradiation to a sample on a result of mass spectrometry, and can measure mass distribution with high reliability. A mass distribution measuring method according to the present invention includes: changing a direction of irradiating the ionizing beam to a sample surface; acquiring a plurality of mass distribution images in a plurality of incident directions; performing image transform of the mass distribution images according to an angle formed by an incident direction of the ionizing beam and a substrate surface; synthesizing the plurality of transformed images; and outputting the synthesized mass distribution images.

11 Claims, 8 Drawing Sheets

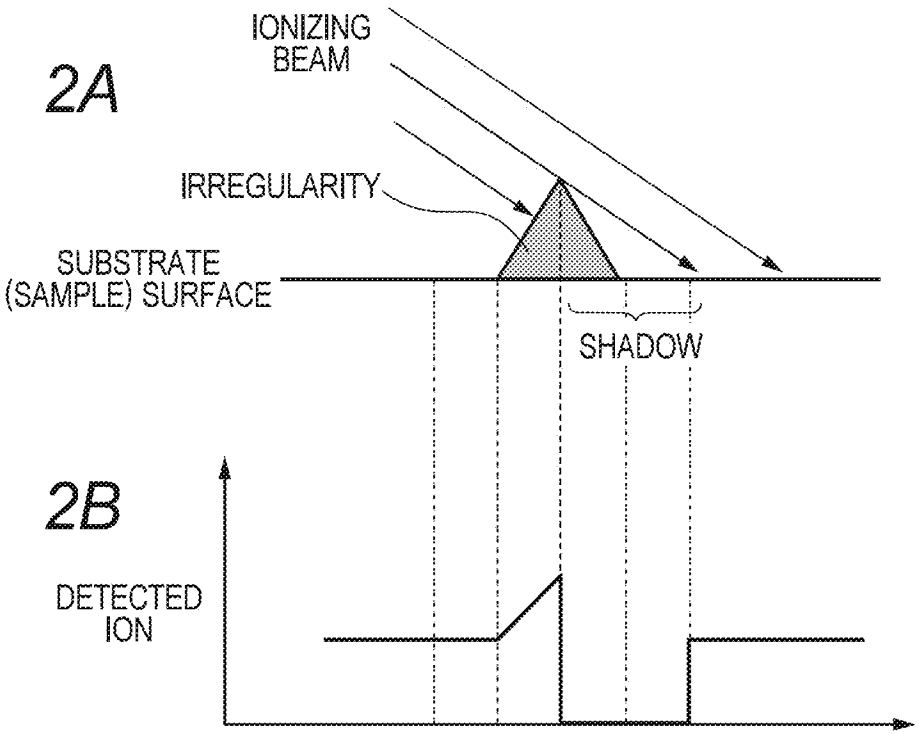
FIG. 2A
FIG. 2B
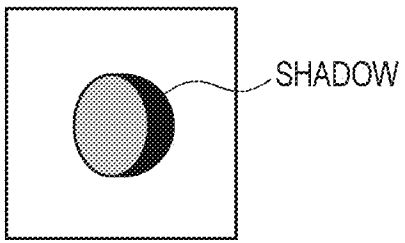
FIG. 2C

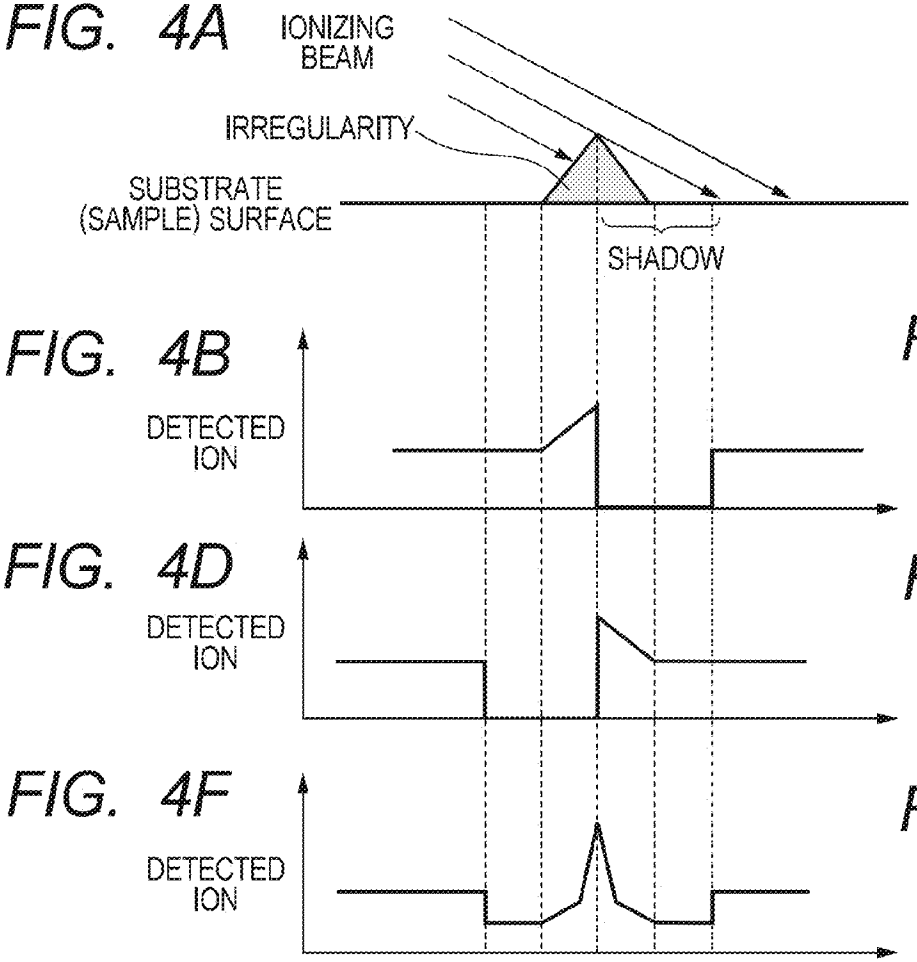
FIG. 4A
FIG. 4B
FIG. 4D
FIG. 4F
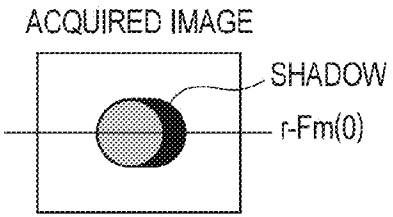
FIG. 4C
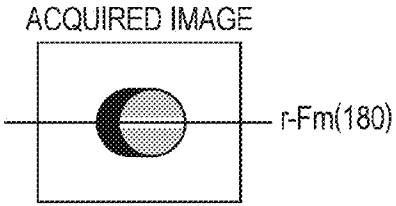
FIG. 4E
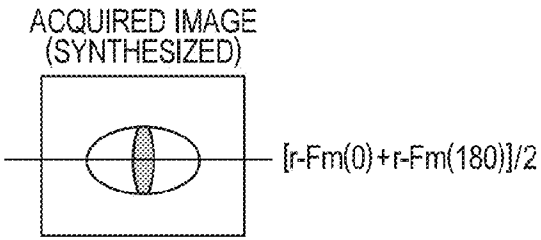
FIG. 4G

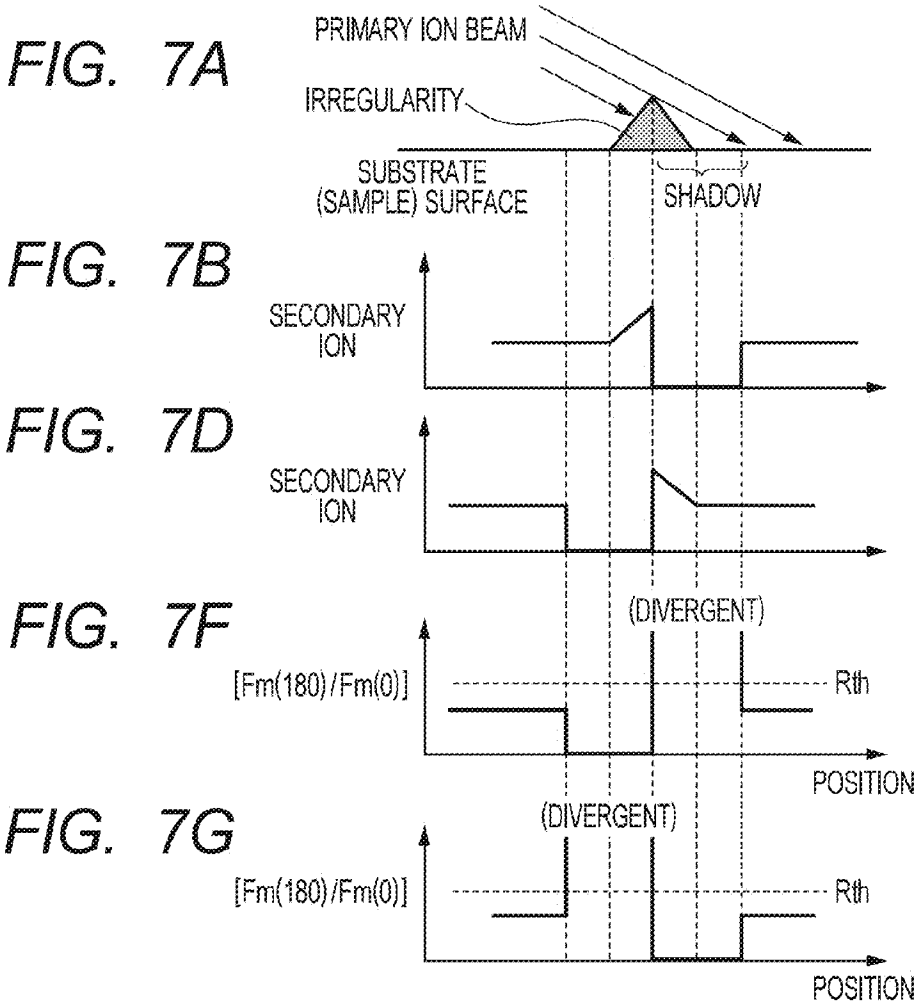
FIG. 7A
FIG. 7B
FIG. 7D
FIG. 7F
FIG. 7G
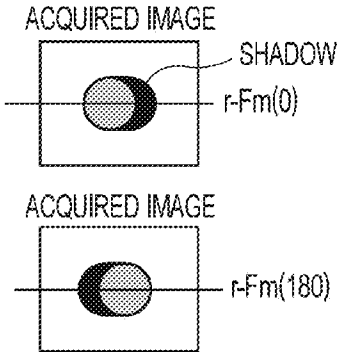
FIG. 7C
FIG. 7E

MASS DISTRIBUTION MEASURING METHOD AND MASS DISTRIBUTION MEASURING APPARATUS

BACKGROUND OF THE INVENTION

1. Field of the Invention

The present invention relates to a method for ionizing a substance on a sample, performing mass spectrometry of the substance, and imaging and outputting in-plane distribution of the substance, and an apparatus used therefor.

2. Description of the Related Art

As an analyzing method for comprehensively visualizing distribution information of many substances that constitute body tissue, an imaging mass spectrometry method has been developed, for which a mass spectrometry method is applied. In a mass spectrometry method, a sample is ionized by irradiating a laser light or primary ions and then separated according to a mass-to-charge ratio to obtain a spectrum including the mass-to-charge ratio and detection strength therefor. A sample surface can be subjected to mass spectrometry two-dimensionally so as to obtain two-dimensional distribution of detection strength of a substance corresponding to each mass-to-charge ratio, and obtain distribution information on each substance (mass imaging).

As a mass spectrometry method, a time-of-flight type ion analyzing unit is mainly used that separates and detects ionized target substances depending on differences in time of flight from a sample to a detector. As methods for ionizing the sample, Matrix Assisted Laser Desorption/Ionization (MALDI) of irradiating a pulsed and focused laser light to the sample mixed in a matrix and crystallized, and Secondary Ion Mass Spectrometry (SIMS) of irradiating a primary ion beam to ionize a sample, are known. Among them, the imaging mass spectrometry using MALDI has been widely used for analyzing a biological sample including protein, lipid or the like. However, the MALDI using a matrix crystal limits spatial resolution to several ten μm in principle. Thus, in recent years, Time Of Flight-Secondary Ion Mass Spectrometry (TOF-SIMS), which have high spatial resolution of submicron, has been receiving attention.

In the conventional imaging mass spectrometry method using such methods, a beam for ionization is scanned, and mass spectrometry is successively performed in many minute measurement regions to obtain two-dimensional distribution information. Thus, a considerable time is required to obtain a mass image of a wide region.

To solve this problem, a projection type mass spectrometer has been proposed. In this apparatus, components in a wide region can be collectively ionized, the ions are projected on a detection unit, and thus mass information and two-dimensional distribution of the components can be acquired at one time, thereby measurement time can be significantly reduced. For example, Japanese Patent Application Laid-Open No. 2007-157353 discloses an imaging mass spectrometer that simultaneously records a detection time and a detection position of ions to simultaneously perform mass spectrometry and two-dimensional distribution.

In the time-of-flight mass spectrometer, an axis of an ion optical system that forms a mass spectrometry section is placed perpendicularly to a substrate surface, while generally, a beam for ionization is obliquely incident on a substrate.

When a beam to be a probe is obliquely incident on the substrate, if a substrate or a sample has an irregularity shape (hereinafter referred to as an irregularity on the substrate, or also simply as an irregularity), there appears, around the irregularity, a region to be a shadow to which no beam is irradiated. In this region, a sample is not ionized, and mass spectrometry cannot be performed. Facing this problem, for example, Japanese Patent Application Laid-Open No. 2007-086610 discloses a differential interference microscope including a unit that synthetizes differential interference images obtained from two orthogonal directions, and images a defect with an irregular shape.

SUMMARY OF THE INVENTION

In the conventional imaging mass spectrometer, depending on an incident angle of an ionizing beam on the substrate surface, there appears, around the irregularity, a shadow to which no ionizing beam is irradiated, and mass distribution of this region cannot be accurately measured.

Also, when an ionizing beam having a large diameter is used as in the mass spectrometer described in the Japanese Patent Application Laid-Open No. 2007-157353, non-uniformity of beam strength within the beam noticeably influences measurement of mass distribution in addition to the above problem.

In view of the above problems, The present invention provides a two-dimensional mass distribution measuring method of irradiating an ionizing beam toward a sample surface on a substrate, and detecting information including a mass-to-charge ratio and a detection position of generated ions, further including: changing a direction of irradiating the ionizing beam to the sample surface; acquiring a plurality of mass distribution images by irradiation from a plurality of incident directions; and synthesizing the plurality of mass distribution images, wherein the plurality of mass distribution images obtained by irradiating the ionizing beams from different directions are subjected to rotational transform before being synthesized, so that an absolute coordinate at each point on the sample is aligned with a coordinate of each point corresponding thereto on the mass distribution images.

According to the mass distribution measuring method of the present invention, a plurality of mass distribution images are acquired in the plurality incident directions of ionizing beams, and then the mass distribution images are synthesized and reconstructed after an influence of rotation of the image by the incident directions of the ionizing beams is canceled. Thus, a mass image with high reliability can be acquired with a reduced influence of a shadow to which no ionizing beam is irradiated due to the shape of the substrate, or of non-uniformity in the beam when a wide ionizing beam is used.

Further features of the present invention will become apparent from the following description of exemplary embodiments with reference to the attached drawings.

BRIEF DESCRIPTION OF THE DRAWINGS

FIGS. 2A, 2B and 2C are schematic views for illustrating a relationship between a substrate shape and entry of an ionizing beam according to one embodiment of the present invention.

FIGS. 4A, 4B, 4C, 4D, 4E, 4F and 4G are schematic views for illustrating image synthesizing according to another embodiment of the present invention.

FIGS. 7A, 7B, 7C, 7D, 7E, 7F and 7G are schematic views for illustrating image synthesizing according to the second example of the present invention.

DESCRIPTION OF THE EMBODIMENTS

Preferred embodiments of the present invention will now be described in detail in accordance with the accompanying drawings.

Figure 1:
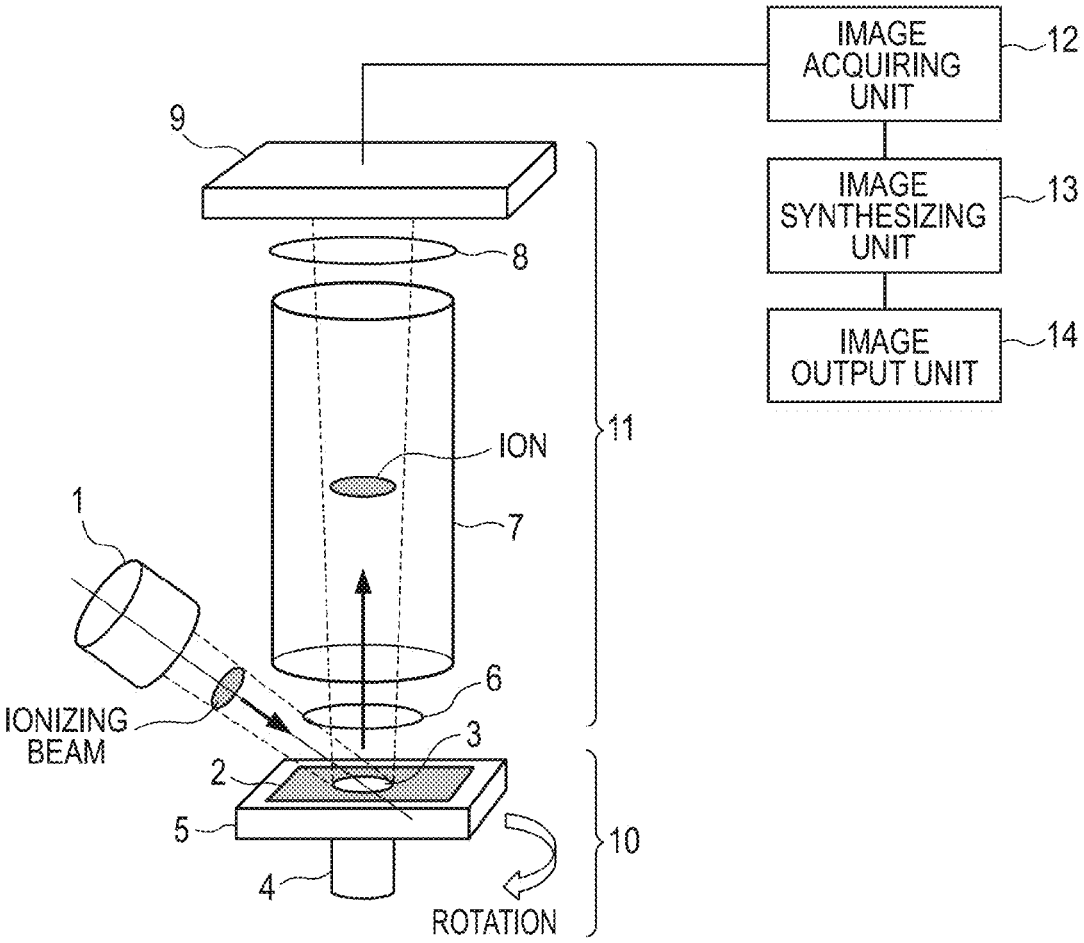
FIG. 1 is a schematic view for generally illustrating an apparatus configuration according to one embodiment of the present invention.

Referring to FIG. 1, a method of the present invention and a configuration of an apparatus used for the method of the present invention will be described herein. FIG. 1 is a schematic view for schematically illustrating an apparatus configuration for carrying out the method according to the embodiment of the present invention. Described is merely an embodiment of the present invention, and the present invention is not limited to them.

A mass distribution measuring apparatus of the present invention includes an ionizing beam irradiation unit 1 that applies an ionizing beam toward a surface of a sample 3 that is placed on a substrate 2, and an ion detection unit 11. The mass distribution measuring apparatus further includes a direction changing unit 10 that changes a direction of irradiating the ionizing beam, an image acquiring unit 12 that acquires a plurality of mass distribution images in a plurality of incident directions, and an image synthesizing unit 13 that synthesizes the plurality of mass distribution images.

Any ionizing method can be used herein as far as it causes an energy beam to be incident on a sample surface. The ionizing beam is selected from ions, a laser light, neutral particles, electrons, or the like depending on analyzing methods. At this time, a method such as MALDI may be used. It should be noted that, when a mass spectrometry method that provides high spatial resolution is used, an influence of a shadow due to an irregularity on a substrate is particularly emphasized. Therefore, an advantage of the present invention can be more noticeable in an SIMS method of using primary ions as an ionizing beam. The method of causing the ionizing beam to be incident on the sample surface is not limited, and any method may be used. For a scanning type, a focused ionizing beam is irradiated, and for a projection type, an ionizing beam is irradiated to a wide region on a sample. The projection type provides higher spatial resolution than the scanning type, and thus an advantage of the present invention is more noticeable. In the projection type, further, a configuration of a mass spectrometry section can be simplified, and thus it has a high affinity for the present invention, and therefore it can be more favorably used.

The sample 3 is in a solid phase, and it may include an organic compound, an inorganic compound, or a biological sample. When MALDI is used, an aromatic organic compound or the like that supports ionization may be added to the sample surface and crystallized. The sample is secured on the substrate 2 having a substantially flat surface.

The mass spectrometry method is not particularly limited. Mass spectrometry methods of various types such as time-of-flight, magnetic deflection, quadrupole, ion trap, or Fourier transform ion cyclotron resonance may be used. When a projection type ion detection is adopted, a time-of-flight mass spectrometry method can be used to simultaneously record a detection time and a detection position of ions.

In one embodiment of the present invention as described herein, primary ions are used as an ionizing beam, and a time-of-flight mass spectrometry method and a projection type two-dimensional ion detection method are adopted. It should be noted that the descriptions below are not intended to limit the present invention to this configuration.

FIG. 1 is a schematic view illustrating an apparatus for carrying out the mass distribution measuring method according to this embodiment. An ionizing beam is emitted for an extremely short time in an emitting direction from the ionizing beam irradiation unit 1, and then irradiated to the sample 3 on the substrate 2. In other words, the ionizing beam is emitted in a pulse shape. A long pulse width increases uncertainty of a secondary ion generation time, and reduces mass resolution. Thus, for example, when an ion beam is used, the pulse can be set to 1 ns or less. The ionizing beam is incident on a surface of the substrate 2 or the sample 3 obliquely of the surface of the substrate 2.

As primary ions, liquid metal ions such as $Bi^+$ and $Ga^+$, metal cluster ions such as $Bi^{3+}$ and $Au^{3+}$, or gas cluster ions such as Ar may be used. Use of the cluster ions can reduce damage to an organic sample.

In standard scanning type TOF-SIMS, an ion beam is focused to a diameter of 1 μm or less. On the other hand, in the projection type exemplified in this embodiment, an ion beam appropriately defocused and having a large diameter is used. A two-dimensional extent, that is, a primary ion irradiation area when a primary ion beam is irradiated onto the sample, is set according to a size of a measurement area. The ion beam herein refers to a group of ions in a pseudo-disk shape or a pseudo-cylindrical shape with a planar extent in direction perpendicular to a traveling direction. When an area including a plurality of cells is measured on a biological sample, a primary ion irradiation area can be set to several ten μm to 1 mm.

The ionizing beam irradiation unit has a function of displacing an ion irradiation position, and it can adjust an irradiation position of the ionizing beam. This displacement function may be performed in conjunction with a change in an incident direction of the ionizing beam described later. For example, the irradiation position may be displaced by a certain distance, and in the position, mass distribution images can be obtained with different incident directions. Mass distribution images with displaced irradiation positions are superimposed to reduce an influence of non-uniformity of the ionizing beam.

The primary ions irradiated to any measurement area on a surface of the sample 3 placed on the substrate 2 simultaneously generate secondary ions over the entire irradiation area.

The ion detection unit 11 mainly includes an extraction electrode 6, a mass spectrometry section 7, and a two-dimensional ion detection section (two-dimensional detection unit) 9. The secondary ions with a mass m are accelerated by a voltage irradiated between the substrate 2 and the extraction electrode 6. The secondary ions pass through a mass spectrometry section 7 while holding a positional relationship of ions in the secondary ion generation position on the surface of the sample 3, and they are detected by a two-dimensional ion detection section 9.

At this time, the substrate 2 or a securing holder for securing the substrate 2 are grounded, and a positive or negative voltage of several kV to several ten kV is irradiated to the extraction electrode 6. An electrode (not shown) that constitutes a projection type ion optical system is placed downstream of the extraction electrode 6. Such an electrode has a focusing function of limiting spatial extent of the secondary ions, and an expanding function. At this time, any magnification may be set.

The mass spectrometry section 7 is constituted by a cylindrical mass spectrometric tube called a flight tube. The inside of the flight tube is equipotencial, and the secondary ions fly in the flight tube at a certain speed. The time of flight is proportional to the square root of a mass-to-charge ratio (m/z; m is mass and z is valence of ion), and thus measuring the time of flight allows analysis of a mass of the generated secondary ions.

The secondary ions having passed through the mass spectrometry section 7 are projected on the two-dimensional detection unit 9. At this time, a projection adjusting electrode 8 that constitutes a lens for adjusting a projection magnification may be placed upstream of the two-dimensional detection unit 9 and the mass spectrometry section 7. The two-dimensional detection unit 9 outputs a detection time and a position on a two-dimensional detector in an associated form with each other for each ion. A time of flight is measured from a difference between a generation time and a detection time of the secondary ions and subjected to mass spectrometry.

The two-dimensional detection unit 9 may have any configuration as long as it can detect a time and a position of detection of ions.

For example, as the two-dimensional detection unit 9, a configuration including a combination of a micro-channel plate (MCP) and a two-dimensional photodetector such as a fluorescent screen and a charge coupled device (CCD) may be selected. With a CCD detector having a high-speed shutter function, detecting time-split ions for each imaging frame allows mass separation.

Placing a single element photodetector instead of the two-dimensional detector allows configuration of a detector of a scanning type imaging mass spectrometer.

A direction changing unit 10 includes a rotation mechanism 4 that rotates the direction of the substrate 2, and thus it can change a direction of irradiating the primary ions to the sample 3. At this time, the present invention has a configuration in which the ionizing beam irradiation unit 1, the two-dimensional detection unit 9, and the direction changing unit 10 are secured to the apparatus body, and the direction changing unit 10 rotates the substrate 2. Alternatively, a configuration may be used in which the substrate 2 is secured to the apparatus body, and the ionizing beam irradiation unit 1 is rotated with respect to the substrate 2. FIG. 1 illustrates the former configuration. When the latter configuration is used, the direction changing unit 10 rotates the ionizing beam irradiation unit 1. A configuration may be used in which a plurality of ionizing beam irradiation units having the same function but having different incident directions. The configuration in which the substrate is rotated to change the incident direction of the ionizing beam is more desirable in terms of avoiding complexity of an apparatus configuration and allowing a size reduction.

The rotation of the substrate 2 or the ionizing beam irradiation unit 1, by the direction changing unit 10, is performed around a central point of an area to be measured. The central point matches a central axis of an ion optical system that forms the mass spectrometry section. The rotation axis of the rotation mechanism 4 is adjusted to match the central point of the area to be measured. A translation mechanism 5 that can arbitrarily displace the substrate 2 in XY directions can be provided on the rotation mechanism 4. When the area to be measured is changed, the translation mechanism 5 is operated. Using the translation mechanism 5 in combination allows any region on the sample 3 to be set as a region to be measured. Also, when a rotation operation is performed, a large displacement of the area to be measured on the sample 3 can be easily avoided.

An image acquiring unit 12 acquires a plurality of mass distribution images sent from the two-dimensional detection unit 9 and obtained by irradiating ionizing beams from a plurality of incident directions, and reconstructs a mass distribution image (hereinafter referred to as a first mass distribution image) based on information on a detection time and a detection position of each ion. At this time, ions detected between a certain time t and a time t+Δt after a lapse of a minute time Δt are recognized as ions having the same mass-to-charge ratio, and the number of detected ions is counted. The number of detected ions can be output as an image correspondingly to positional information to configure distribution of the number of detected ions, that is, a first mass distribution image, for certain ions. The same operation is performed for a plurality of mass-to-charge ratios. Otherwise, the first mass distribution image may be a distribution of the number of detected ions. The image acquiring unit 12 acquires a plurality of first mass distribution images corresponding to a plurality of directions at the times the direction changing unit 10 changes the incident direction of ions to the plurality of directions.

In the present invention, the mass distribution image refers to information such as a mass-to-charge ratio or a detection position of ions obtained by the two-dimensional detection unit 9, which is used in synthesizing mass distribution images.

At this time, with an irregularity on the substrate 2 (FIG. 2A), there appears a region to be a shadow to which no primary ion beam is irradiated (FIG. 2B), and thus a region from which no secondary ion is detected is drawn like a shadow also on the image (FIG. 2C).

Figure 3:
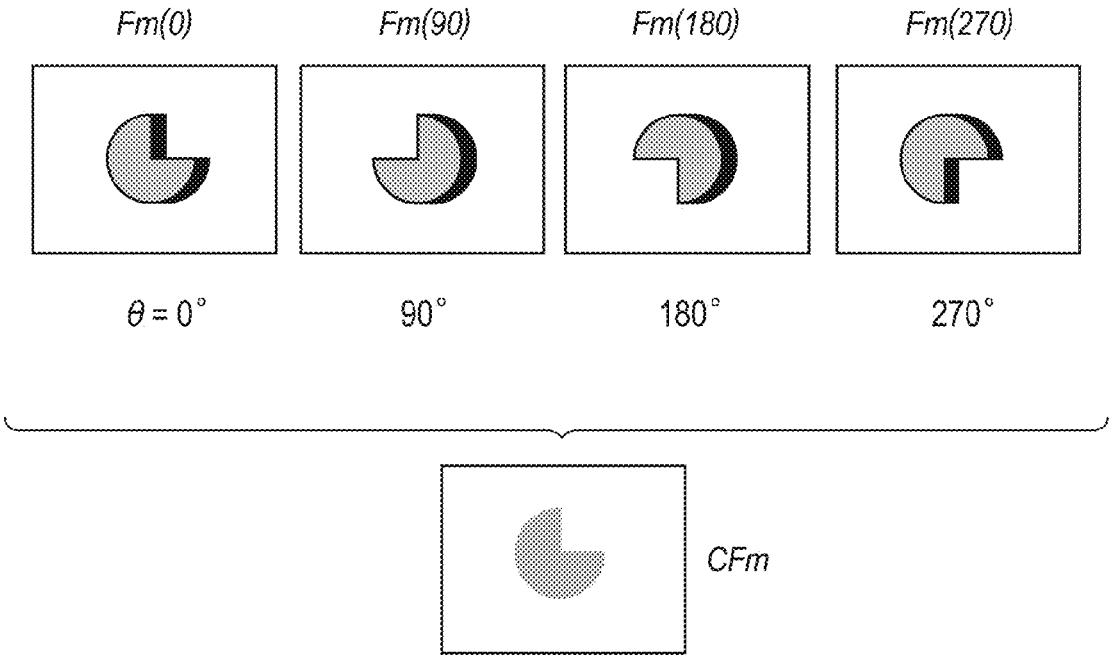
FIG. 3 is a schematic view for illustrating image synthesizing according to one embodiment of the present invention.

As illustrated in FIG. 3, near the irregularity on the substrate, an appearance position of a shadow region from which no secondary ion is detected changes depending on the ion incident direction. An angle formed by, an incident direction of ion irradiation to the sample before rotation, and an incident direction of ion irradiation to the sample after rotation, is hereby set as a rotation angle θ. This angle may be referred to as an amount of change of an angle formed by a direction of ions incident on a plane of the substrate 2 (projection direction) and a reference direction on the plane of the substrate 2.

In the present invention, a plurality of arbitrary directions may be set as incident directions of the ionizing beam.

For example, irradiation of the ion beam from two directions allows the ionizing beams to be irradiated to most parts if a difference between rotation angles of the beams is 90° or more. Thus, to reduce parts to which no beam is irradiated, ionizing beams can be irradiated from facing directions or symmetrical directions. Further, ionizing beams can be irradiated from more than two directions.

Then, the image synthesizing unit 13 reconstructs and outputs one mass distribution image (hereinafter referred to as a second mass distribution image or a synthesized image) based on a plurality of mass distribution images obtained by irradiating ions from different angles among mass distribution images acquired by the image acquiring unit 12. A first mass distribution image of ions having a mass-to-charge ratio m/z at an incident angle θ of the ionizing beam is set as Fm(θ). The image synthesizing unit 13 synthesizes the second mass distribution image Cfm based on a plurality of first mass distribution images having different angles formed by an incident direction of ion irradiation and a substrate placing direction (FIG. 3).

More specifically, the image synthesizing unit 13 performs a rotational transform operation of the first mass distribution image according to an angle formed by the incident direction of ion irradiation and the placing direction of the substrate 2, an absolute coordinate of each point on the sample is aligned with a coordinate of each point corresponding thereto on the mass distribution image, and then the images are synthesized. For example, the mass distribution image is rotated $-\theta$ with respect to the rotation angle $\theta$ to perform rotational transform of the first mass distribution image. Further, for a plurality of images having coordinates aligned by performing the rotational transform operation, the number of detected ions is averaged for each pixel to obtain a synthesized image. The synthesized image is displayed or output as a second mass distribution image by an image output unit 14. As described above, an influence of a shadow due to a surface shape is canceled to obtain a mass distribution image without a region from which no ion is detected.

The image acquiring unit 12, the image synthesizing unit 13, and the image output unit 14 may be integrated circuits having a dedicated calculation function and a memory, or may be formed as software in a general-purpose computer.

As described above, merely performing the image rotation operation and averaging can sufficiently cancel the influence of the shadow. In addition, solving the problems described below can further reduce the influence of the shadow. Specifically, in the obtained synthesized image, around the irregularity, the number of detected ions is smaller than an original value. This state is illustrated in FIGS. 4B to 4G for the case where primary ion beams are irradiated to a sample in FIG. 4A from two directions of $\theta=0$ and 180. When $\theta=0$, that is, the primary ion beam is irradiated from obliquely leftward and upward on the sheet and to perform rotational transform, a sectional profile of the number of detected ions in FIG. 4B and an ion distribution image r-Fm(0) in FIG. 4C are obtained. When $\theta=180$, that is, the primary ion beam is irradiated from obliquely rightward and upward on the sheet and to perform rotational transform, a sectional profile of the number of detected ions in FIG. 4D and an ion distribution image r-Fm(180) in FIG. 4E are obtained. By averaging the images, a sectional profile of the number of detected ions illustrated in FIG. 4F, and a synthetic ion distribution image of an average of r-Fm(0) and r-Fm(180) in FIG. 4G, are obtained. A schematic view (FIG. 4A) illustrating an incident direction of the ion beam illustrates only a case where the ion beam is $\theta=0$, that is, the ion beam is incident from obliquely leftward and upward on the sheet.

The above problem can be avoided by forming a synthesized image using a synthesizing method described below.

First, the image synthesizing unit 13 selects a pair or a plurality of first mass distribution images obtained by irradiating primary ions at different rotation angles $\theta$. A rotational transform image is obtained for each mass distribution image. Then, rotational transform images are compared to perform judgment and calculation described below to form a synthesized image. At this time, information on a pixel in the region judged that no ion is detected due to a shadow or non-uniformity of an ionizing beam is not used, and information on a pixel in which ions are detected from a corresponding region of any image is used. The information as used herein exemplary refers to image information on the number of detected ions. The region judged that no ion is detected is extracted to form a judged information image, that is, an image on shadow information.

In other words, it can be said that the operation described above performs a calculation described below. First, in a rotational transform image, a pixel from which no ion is detected (or a pixel where the number of ions detected therefrom is below a preset threshold value) is set to false (zero). The rotational transform images are XORed (a calculation result is regarded as true when only one value is true), and the calculation result is represented in an XOR image. The image shows that a pixel of a true value is influenced by a shadow. Specifically, the XOR image can be regarded as an image on shadow information.

Then, calculation is performed for each pixel between the rotational transform images to obtain a synthesized image. At this time, in an address corresponding to the pixel of the true value in the XOR image, a sum of rotational transform images is obtained. In an address corresponding to a zero value in the XOR image, the rotational transform images are averaged.

Then, a pair or plurality of first mass distribution images are selected obtained by irradiating primary ions from a direction different from that of the selected first mass distribution image. For the newly selected first mass distribution image, a synthesized image is formed as described above. A plurality of synthesized images obtained by successively performing the same operation may be averaged to form a final synthesized image.

By such a series of processes, a synthesized image can be obtained with a significantly reduced influence of a shadow. By the processes, further, an influence due to non-uniformity in ion density in an irradiation plane of primary ions having a wide irradiation area can be reduced.

In the above processes, the first mass distribution image obtained by each irradiation may be used as it is. Otherwise, the first mass distribution images are first averaged for the same incident angle $\theta$, and then the series of processes described above are performed, thereby reducing an influence due to variations in data for each irradiation.

In the case where the number of detected ions is insufficient with only ions of a target sample component, correction calculation can be properly performed by processes described below. First, all ions, one type of ions that can be detected in a sufficient number, or a combination of plural types of ions are used as standard ions. Based on information on the standard ions, an influence of a shadow or non-uniformity in density of the primary ions is judged for each image pixel. A result of judgment performed based on a standard image for each corresponding pixel is applied to a mass distribution image of the ions of the target sample component.

The image output unit 14 has a function of outputting a synthesized image, and also has a function of imaging the result of judgment performed for each image pixel and simultaneously outputting the result. For example, the result of judgment whether there is a shadow or not is represented by 0 and 1 for each image pixel to form a judged information image with the values being mapped. Alternatively, the above XOR image may be a judged result image. The image output unit can display any of the judged information image in parallel with the synthesized image, and/or a superimposed image thereof. This easily shows whether a strength change of the ion count on the synthesized image is caused by an irregularity on the sample.

Rotation by the direction changing unit 10 is controlled so that a center of rotation matches a center of an area to be measured. The center of rotation is controlled to match the center of a secondary ion optical system. A method such as pattern matching of images may be used to accurately match positional information after rotational transform of images with changed $\theta$. To more strictly match the positional information, image positional information may be corrected with reference to a positioning marker formed on the substrate to form a synthesized image.

At this time, a marker may be previously formed on the substrate, or a marker forming mechanism may be provided in the apparatus to form a marker in a predetermined region after the substrate is introduced into the apparatus. To form a marker, for example, a method of forming a metal minute spot by focused ion beam deposition may be used.

EXAMPLES

Now, the present invention will be described with specific examples. It should be noted that the present invention is not limited to the examples.

In the examples below, a first mass distribution image obtained when a substrate rotation angle is θ is set as F(θ). A first mass distribution image obtained based on the entire ion distribution is set as F0(θ), and a first mass distribution image relating to a mass-to-charge ratio (m/z) is set as Fm(θ).

Example 1

Figure 5:
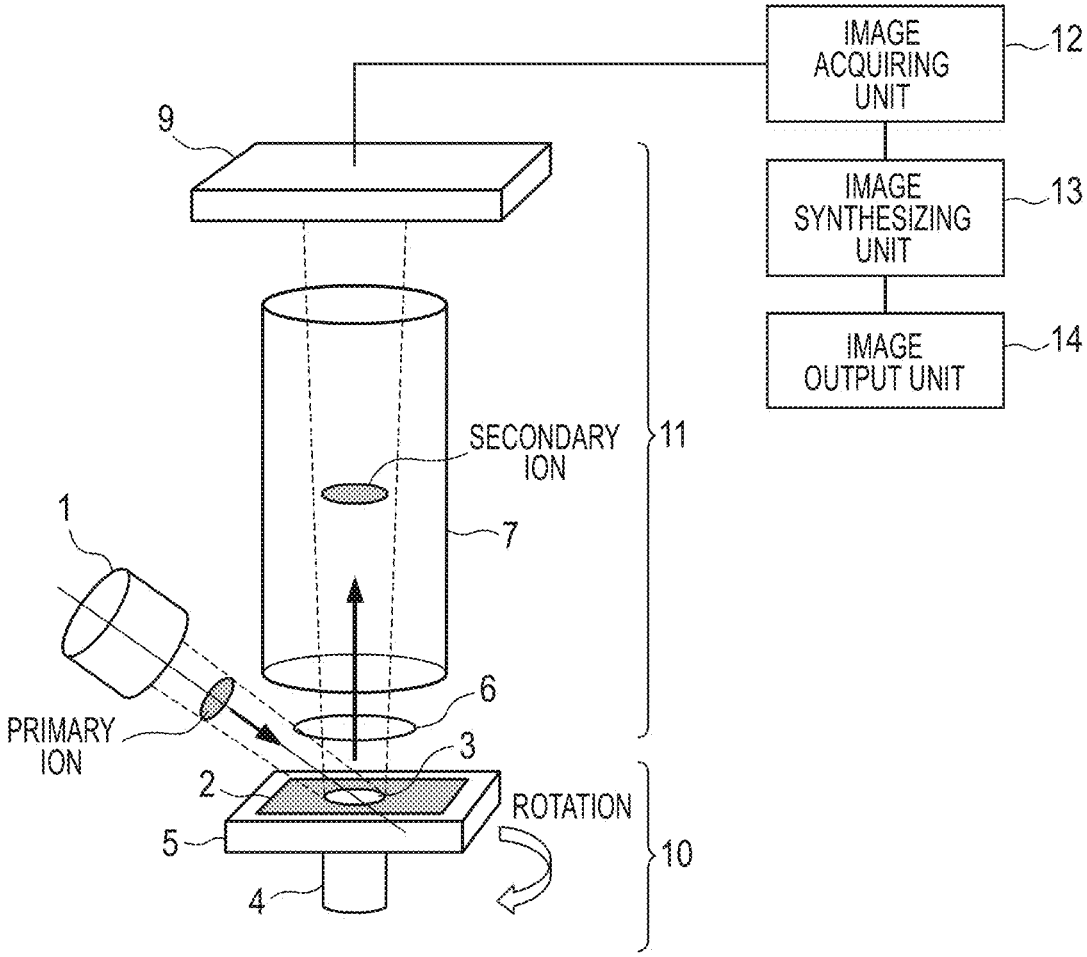
FIG. 5 is a schematic view generally illustrating an apparatus configuration according to first to third examples of the present invention.
Figure 6:
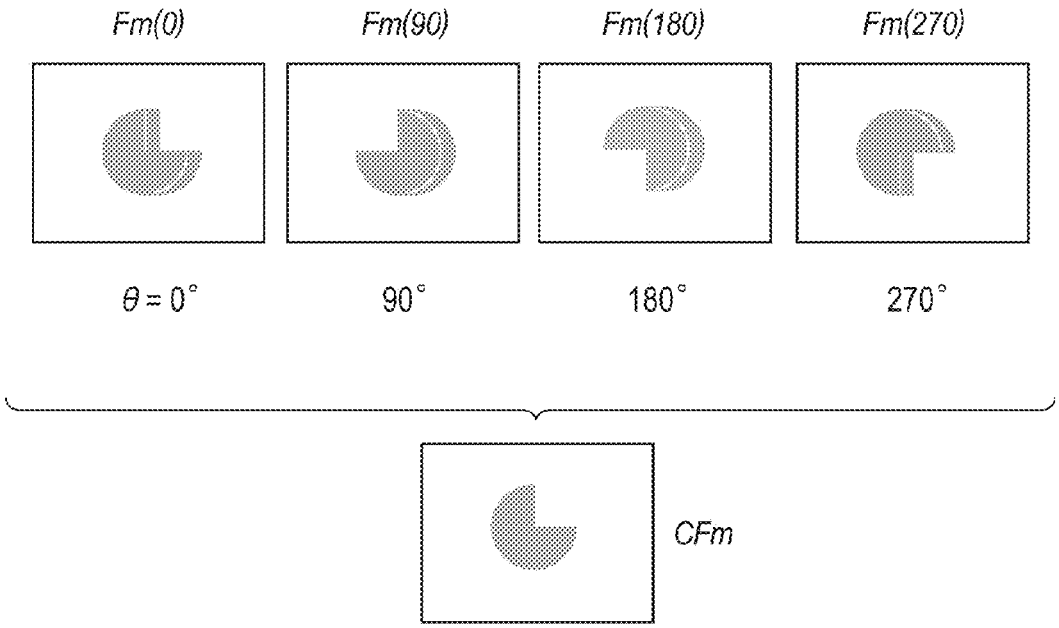
FIG. 6 is a schematic view for illustrating image synthesizing according to the first example of the present invention.

With reference to FIGS. 5 and 6, a first example according to the present invention will be described. FIG. 5 is a schematic view of a configuration of an apparatus for carrying out the method of the present invention in this example.

A conductive substrate is used as a substrate 2, and a protrusion pattern that can specify a direction is formed on the substrate 2 using a photolithography process or the like. A sample 3 such as a biological sample holding a thin cell form is placed on the substrate 2.

A direction changing unit 10 includes a rotation mechanism 4, and a translation mechanism 5. The translation mechanism 5 is placed on the rotation mechanism 4. The translation mechanism 5 is displaceable in a direction perpendicular to a rotation axis. The substrate 2 is placed on the translation mechanism 5 so that a plane of the substrate 2 is perpendicular to a rotation axis of the rotation mechanism 4.

Primary ions are used as a beam output by an ionizing beam irradiation unit 1. $Ga^+$, $Bi^+$ or the like is used as the primary ions. A primary ion beam having a diameter defocused to about 500 μmϕ is used. The primary ion beam is emitted in a pulse shape of several ns or less. An angle formed by an incident direction of the primary ion beam and a surface of the substrate 2 is set to 45°.

An ion detection unit 11 includes a time-of-flight mass spectrometry section 7, and a two-dimensional ion detection section 9. A region to be measured is several hundred μm square, and the number of pixels of drawing of a mass distribution image is set to 256×256 or the like. A secondary ion extraction electrode 6 and the substrate 2 are placed with a space of several mm therebetween, and a secondary ion extraction voltage of several kV is applied therebetween.

In this example, the substrate is rotated every 90° to apply primary ion beams from a total of four directions to acquire a mass spectrum. The rotation angle of the substrate can be arbitrarily set. For example, the substrate may be rotated every 120° or 60° to apply primary ion beams from a total of three or six directions. The rotation mechanism 4 is rotated to change the primary ion incident direction, and the primary ion beam is irradiated in each rotational direction a plurality of times (several to several ten thousand times), and secondary ions are measured.

The image acquiring unit 12 outputs data on a position and a mass acquired by the two-dimensional ion detection section 9 on a memory. Further, the image acquiring unit 12 reconstructs, from this data, a first mass distribution image for a signal at a specific mass-to-charge ratio (m/z) corresponding to a rotation angle of the substrate, and outputs the image on the memory.

Then, the image synthesizing unit 13 performs rotational transform of the mass distribution image by an imaging process according to the rotation angle θ of the substrate 2. At this time, for the first mass distribution image F(θ) when the substrate 2 is rotated by the angle θ seen from above the substrate 2, a transform process of −θ rotation is performed. The same process is performed for a signal having the same mass-to-charge ratio at all substrate rotation angles. Finally, all ion images having been subjected to rotational transform are superimposed and averaged to reconstruct a synthesized image, as shown in FIG. 6. The image output unit 14 displays or outputs the synthesized image.

By the process, in the synthesized image, the irregularity of the substrate noticeably reduces an influence of a shadow on which no primary ion is incident. Also for regions other than the irregularity, an influence of non-uniformity of the primary ions is noticeably improved. As described above, the mass distribution measuring apparatus in this example provides a satisfactory mass distribution image with reduced dependence of a primary ion in an incident direction.

Example 2

A second example according to the present invention will be described with reference to FIGS. 7A to 7G. This example is different from Example 1 in an image synthesizing process. An apparatus configuration used in this example is the same as in Example 1, and thus descriptions thereof will be omitted.

In this example, the substrate 2 is rotated every 90° to apply primary ion beams from a total of four directions. The rotation angle of the substrate 2 can be arbitrarily set, provided that a pair of angles can be set so that measurement is performed at 180° different rotation angles. Specifically, when the substrate rotation angle is set as θ (degree), a pair of θ=0 and 180, and a pair of θ=90 and 270 are set.

The mass distribution measuring apparatus perform a plurality of times of measurements in each of the plurality of rotation directions, and stores data on an ion detection position and a mass-to-charge ratio. After a series of measurement for each direction is completed, the substrate 2 is further rotated, and the same measurement is repeated. The order of rotation of the substrate and the ion irradiation is not limited to this, and for example, the substrate may be rotated for single ion irradiation and measurement so that plural times of measurements are performed in one incident direction (rotation angle).

The image acquiring unit 12 reconstructs a first mass distribution image for a signal having a representative mass-to-charge ratio from mass spectrum information with positional information acquired at each substrate rotation angle θ, and it further performs rotational transform of the image according to a rotation angle of the substrate. When θ=0, that is, the primary ion beam is irradiated from obliquely leftward and upward on the sheet to perform rotational transform, a sectional profile in FIG. 7B and an ion distribution image after the rotational transform in FIG. 7C are obtained. When θ=180, that is, the primary ion beam is irradiated from obliquely rightward and upward on the sheet to perform rotational transform, a sectional profile in FIG. 7D and an ion distribution image in FIG. 7E are obtained.

The image synthesizing unit 13 reconstructs a synthesized image by a method described below. First, a pair of images r-F0(0) and r-F0(180) are subjected to processes described below. When r-F0(0) and r-F0(180) are compared for each pixel, and both have signal intensity of zero or less, it is judged that the pixel includes no ion signal. This judgment result is stored in a first reference table. Similarly, the same judgment as above is performed for another pair of images r-F0(90) and r-F0(270), and the judgment result is stored in a second reference table.

Then, ion count ratios R1=r-F0(0)/r-F0(180) (FIG. 7F) and R2=r-F0(180)/r-F0(0) (FIG. 7G) are calculated for each corresponding region in each image. When a denominator is negative, an absolute value is used as the ion count ratio. A threshold Rth of the ion count ratio is set. By way of example, Rth is 100 herein, but setting may be changed depending on states of a synthesized image. It is considered that in a region of a shadow to which no ion beam is irradiated, the number of detected ions is extremely small, while a value of a division result is extremely large. Thus, it can estimated that a region with a result of division higher than a threshold arbitrarily set is a region with the reduced number of detected ions because a shadow to which no ion beam is irradiated appears when an image of a denominator is acquired.

When there is a region with R1 higher than Rth, it is judged that ions are not counted because the region in the image r-F0(180) is a shadow to which no ion beam is irradiated, and information on the image r-F(0) is used. The region refers to an address of a pixel of an image corresponding to a position on the sample. For a region with R2 higher than Rth, information on the image r-F(180) is used. For the other regions, average information of r-F(0) and r-F(180) is used. A pixel judged to have no ion signal is eliminated from judgment whether there is a shadow or not performed herein. The judgment result is stored in the first reference table. Then, the same judgment as above is performed for another pair of images r-F0(90) and r-F0(270) to store the judgment result in the second reference table.

Rth can be set as described below by signal intensity and a noise value. First, an evaluation region including a plurality of pixels is set, and for signals in the region, an average value of the signals, and fluctuations of the signals, or noises are extracted. An average value of the signals is set as $\mu$, and a standard deviation is set as $\sigma$. In the case of $\mu \geq 10\sigma$, Rth is set within a range of $(\mu+3\sigma)/(\mu-3\sigma)<Rth<(\mu-3\sigma)/3\sigma$. Depending on the situation, Rth can be set to a larger value within this range. When noise is relatively high with respect to a signal like $\mu<10\sigma$, though accurate judgment is difficult, a value within a range of 1 to 3 can be set as Rth. Extraction of $\mu$ and $\sigma$ can be performed in combination with frequency analysis. For example, in the case of a biological sample, a signal with a shorter cycle than the scale of cell can be regarded as noise.

Although the judgment above is performed based on all mass images, ions relating to one or a plurality of specific mass-to-charge ratios with a large detection count may be used as standard ions, and judgment may be performed based on the image of the standard ion.

Next, image synthesizing of ions having an arbitrary mass-to-charge ratio (m/z) is performed as described below using the first and second reference tables.

For images having an arbitrary mass-to-charge ratio, a pair of images r-Fm(0) and r-Fm(180) are selected and a first reference table is referred to for the images. For each pixel in a synthesized image, a synthesized image CFm1 is output without using data of a region judged to be a shadow. At this time, for the region from which no ion is detected, sum of the images can be obtained. For a from which ion is detected, the mass distribution images can be averaged. Then, a pair of images r-Fm(90) and r-Fm(270) are selected, a second reference table is referred to for the images, and the same information selection operation is performed to output a synthesized image CFm2. Then, a synthesized image CFm as an average of the images CFm1 and CFm2 is output. As data of a region judged to have no signal, a zero value is used.

In the synthesized image CFm, the irregularity on the substrate noticeably reduces an influence of a shadow on which no primary ion is incident. Also for regions other than the irregularity, an influence of non-uniformity of the primary ions is noticeably improved. As described above, the mass distribution measuring apparatus in this example provides a satisfactory mass distribution image with reduced dependence of a primary ion in an incident direction.

Figure 8:
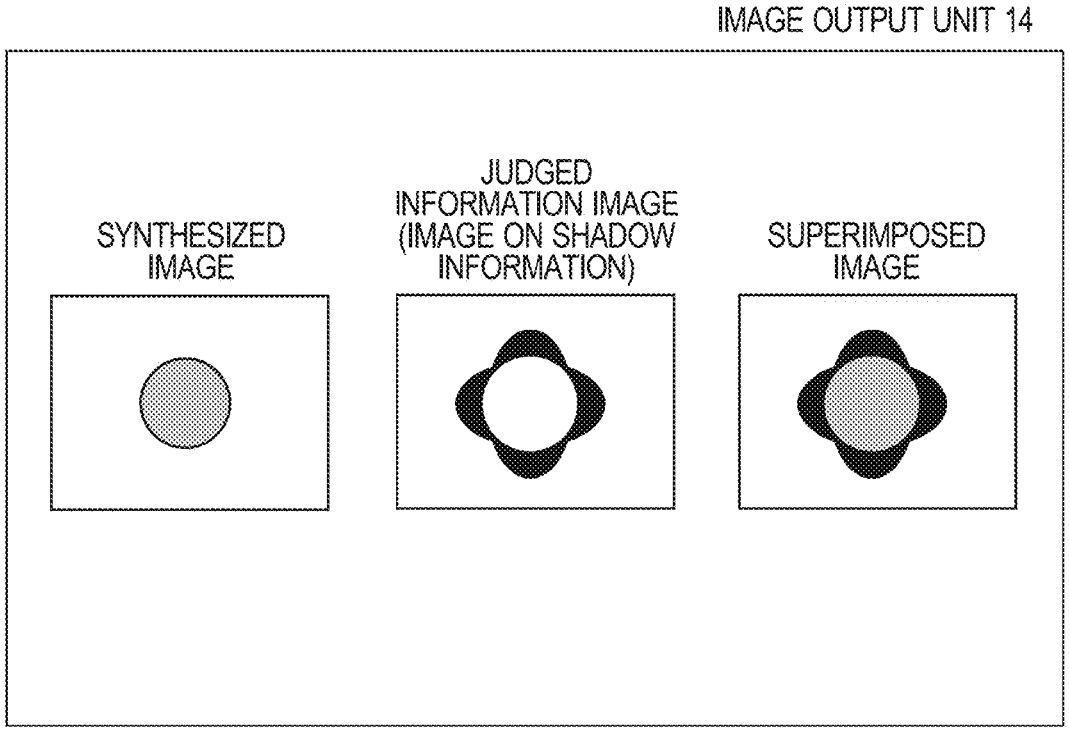
FIG. 8 is a schematic view for illustrating image synthesizing according to the second example of the present invention.

Based on the first and second reference tables, the result of judgment whether there is a shadow or not is represented by 0 and 1 for each image pixel to form a judged result image with the values being mapped. As illustrated in FIG. 8, the image output unit 14 displays the judged information image (herein, image on shadow information) in parallel with the synthesized image Cfm, and/or a superimposed image thereof. Although FIG. 8 displays, in a superimposed manner, regions to be a shadow by irradiation of ion beams from four directions, only a region to be a shadow by irradiation of an ion beam only from one direction may be displayed. This easily allows contrast of ion count distribution on a synthesized image and presence or absence of an irregularity.

Example 3

This example is partially different from Example 2 in an image synthesizing process. An apparatus configuration is the same as in Example 2, and thus descriptions thereof will be omitted. In this example, mass distribution images having different incident angles $\theta$ of primary ions are successively compared to form a synthesized image.

To apply primary ions from three directions, $\theta$=0, 120, 240 (degrees) are set. For each $\theta$, a mass distribution image is acquired and subjected to rotational transform to form r-F0($\theta$).

First, r-F0(0) and r-F0(120) are compared. A comparing method is basically the same as comparison between r-F0(0) and r-F0(180) in Example 2. The comparison result is stored in a first reference table. A synthesized image CFm1 is output based on the first reference table.

Then, the synthesized images CFm1 and r-F0(240) are compared as described above, and the comparison result is stored in a second reference table. A synthesized image CFm is output based on the second reference table. In the case where more values of $\theta$ are set, and primary ion beams are irradiated from multiple directions, the same processes are successively performed to obtain a synthesized image CFm.

Example 4

This example is partially different from Example 2 in an image synthesizing process. The other processes and the apparatus configuration used are the same as in Example 2, and thus descriptions thereof will be omitted.

The image synthesizing unit 13 compares images r-Fm($\theta$1) to r-Fm($\theta$4) at all $\theta$ for each image pixel of images having an arbitrary mass-to-charge ratio. Information on an image having information corresponding to a largest ion count is selected and used as a pixel value of a corresponding address of a synthesized image.

Also by the process, in the synthesized image, the irregularity on the substrate noticeably reduces an influence of a shadow on which no primary ion is incident. Also for regions other than the irregularity, an influence of non-uniformity of the primary ions is noticeably improved. As described above, the mass distribution measuring apparatus in this example provides a satisfactory mass distribution image with reduced dependence of a primary ion in an incident direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-225019, filed Oct. 12, 2011, and No. 2012-202877, filed Sep. 14, 2012, which are hereby incorporated by reference herein in their entirety.

What is claimed is:

1. A mass distribution measuring method of irradiating an ionizing beam toward a sample surface on a substrate, and detecting information including a mass-to-charge ratio and a detection position of generated ions, further comprising:

changing a direction of irradiating the ionizing beam to the sample surface;

acquiring a plurality of mass distribution images by irradiation from a plurality of incident directions; and synthesizing the plurality of mass distribution images, wherein the plurality of mass distribution images obtained by irradiating the ionizing beams from different directions are subjected to rotational transform before being synthesized, so that an absolute coordinate at each point on the sample is aligned with a coordinate of each point corresponding thereto on the mass distribution images.

2. The mass distribution measuring method according to claim 1, wherein the direction of irradiating the ionizing beam to the sample surface is changed by rotating the substrate.

3. The mass distribution measuring method according to claim 1, wherein the ionizing beam has a two-dimensional extent and a pulse shape, the detection position is detected while holding a positional relationship of ions in an ion generation position generated on the sample surface, and the mass-to-charge ratio is calculated by measuring time of flight of the generated ions.

4. The mass distribution measuring method according to claim 1, wherein the plurality of mass distribution images obtained by irradiating the ionizing beams from different directions are compared to calculate a region from which no ion is detected due to a shadow or non-uniformity of the ionizing beam on one mass distribution image, and the plurality of mass distribution images obtained by irradiating the ionizing beams from different directions are synthesized to form a synthesized image without using information on the region.

5. The mass distribution measuring method according to claim 4, wherein the synthesized image is formed without using information on a mass distribution image of a denominator, for regions in which an ion count ratio of all ions or selected ions calculated for each corresponding region between two mass distribution images selected from the plurality of mass distribution images is larger than a preset threshold.

6. The mass distribution measuring method according to claim 4, wherein when the synthesized image is formed, information on the region from which no ion is detected due to a shadow or non-uniformity of the ionizing beam on one mass distribution image is output to form a judged information image representing information on the region.

7. The mass distribution measuring method according to claim 6, wherein, the mass distribution images are synthesized by, a sum of the mass distribution images is obtained for the region from which no ion is detected, and the mass distribution images are averaged for a from which ion is detected.

8. The mass distribution measuring method according to claim 1, wherein the mass distribution images are synthesized by selecting, for each region, information on a mass distribution image having a largest ion count among the plurality of mass distribution images.

9. A mass distribution measuring apparatus comprising:

an ionizing beam irradiation unit that irradiates an ionizing beam toward a sample surface on a substrate; and an ion detection unit that detects information including a mass-to-charge ratio and a detection position of ions generated by irradiating the ionizing beam, wherein the apparatus further comprises:

a direction changing unit that changes a direction of irradiating the ionizing beam to the sample surface;

an image acquiring unit that acquires a plurality of mass distribution images from each information detected by irradiation from a plurality of incident directions; and an image synthesizing unit that synthesizes the plurality of mass distribution images, and wherein the image synthesizing unit aligns an absolute coordinate at each point on the sample with a coordinate of each point corresponding thereto on the images by rotational transform for the plurality of mass distribution images obtained by irradiating the ionizing beams from different directions before synthesizing the mass distribution images.

10. A mass distribution measuring apparatus comprising:

an ionizing beam irradiation unit that irradiates an ionizing beam toward a sample surface on a substrate; and an ion detection unit that detects information including a mass-to-charge ratio and a detection position of ions generated by irradiating the ionizing beam, wherein the apparatus further comprises:

a direction changing unit that changes a direction of irradiating the ionizing beam to the sample surface;

an image acquiring unit that acquires a plurality of mass distribution images from each information detected by irradiation from a plurality of incident directions; and an image synthesizing unit that synthesizes the plurality of mass distribution images, and wherein, the image synthesizing unit aligns an absolute coordinate at each point on the sample with a coordinate of each point corresponding thereto on the images by rotational transform for the plurality of mass distribution images obtained by irradiating the ionizing beams from different directions before synthesizing the mass distribution images, the image synthesizing unit further compares the plurality of mass distribution images to judge a region from which no ion is detected due to a shadow or non-uniformity of the ionizing beam on one mass distribution image, and forms a judged information image that is the judged information imaged, and the apparatus further comprises an image output unit that simultaneously displays the synthesized image and the judged information image.

11. An image acquiring method of acquiring a synthesized image with a reduced influence of an irregularity on a sample surface, comprising:

obtaining a plurality of mass distribution images by irradiating ionizing beams to the sample surface from different directions;

transforming the plurality of mass distribution images so that an absolute coordinate at each point on the sample is aligned with a coordinate of each point corresponding thereto on the mass distribution images; and displaying the plural pieces of transformed image information in a superimposed manner.

* * * * *